US008999617B2

(12) United States Patent
Iida et al.

(10) Patent No.: US 8,999,617 B2
(45) **Date of Patent: *Apr. 7, 2015**

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: Fuji Xerox Co., Ltd., Tokyo (JP)

(72) Inventors: Yoshifumi Iida, Kanagawa (JP); Takeshi Iwanaga, Kanagawa (JP); Yuka Zenitani, Kanagawa (JP); Yasunobu Kashima, Kanagawa (JP); Chika Hama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 12 days.

This patent is subject to a terminal disclaimer.

(21) Appl. No.: 13/951,082

(22) Filed: Jul. 25, 2013

(65) Prior Publication Data

US 2014/0295340 A1 Oct. 2, 2014

(30) Foreign Application Priority Data

Mar. 26, 2013 (JP) ..... 2013-064974

(51) Int. Cl.
*G03G 9/08* (2006.01)
*G03G 9/097* (2006.01)

(52) U.S. Cl.
CPC ..... *G03G 9/08* (2013.01); *G03G 9/09725* (2013.01)

(58) Field of Classification Search
CPC ..... G03G 9/09725
USPC ..... 430/108.7; 399/252
See application file for complete search history.

(56) References Cited

U.S. PATENT DOCUMENTS

| | | | | |
|---|---|---|---|---|
| 2004/0067189 | A1 | 4/2004 | Sugiura et al. | |
| 2004/0229040 | A1 | 11/2004 | Kudo et al. | |
| 2005/0260515 | A1 | 11/2005 | Kato et al. | |
| 2014/0017607 | A1 * | 1/2014 | Iida et al. | 430/108.6 |

FOREIGN PATENT DOCUMENTS

| | | |
|---|---|---|
| JP | A-2004-102236 | 4/2004 |
| JP | B2-3988936 | 10/2007 |
| JP | B2-132-4190985 | 12/2008 |
| JP | B2-4346403 | 10/2009 |
| JP | B2-4636709 | 2/2011 |
| JP | A-2012-93630 | 5/2012 |

* cited by examiner

*Primary Examiner* — Mark A Chapman
(74) *Attorney, Agent, or Firm* — Oliff PLC

(57) ABSTRACT

An electrostatic charge image developing toner includes toner particles and silica particles that have a titanium content of from 0.001% by weight to 10% by weight in a surface layer, an average particle diameter of from 30 nm to 500 nm, and a particle size distribution index of from 1.1 to 1.5, and are surface-treated with a titanium compound in which an organic group is bonded to a titanium atom via an oxygen atom, and a hydrophobizing agent in sequence.

20 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2013-064974 filed Mar. 26, 2013.

BACKGROUND

1. Technical Field

The present invention relates to an electrostatic charge image developing toner, an electrostatic charge image developer, a toner cartridge, a process cartridge, an image forming apparatus, and an image forming method.

2. Related Art

There is an attempt to control toner properties by incorporating an additive subjected to a surface treatment or the like in a toner.

SUMMARY

According to an aspect of the invention, there is provided an electrostatic charge image developing toner including toner particles and silica particles that have a titanium content of from 0.001% by weight to 10% by weight in a surface layer, an average particle diameter of from 30 nm to 500 nm, and a particle size distribution index of from 1.1 to 1.5, and are surface-treated with a titanium compound in which an organic group is bonded to a titanium atom via an oxygen atom, and a hydrophobizing agent in sequence.

BRIEF DESCRIPTION OF THE DRAWINGS

Exemplary embodiments of the present invention will be described in detail based on the following figures, wherein.

DETAILED DESCRIPTION

Figure 1:
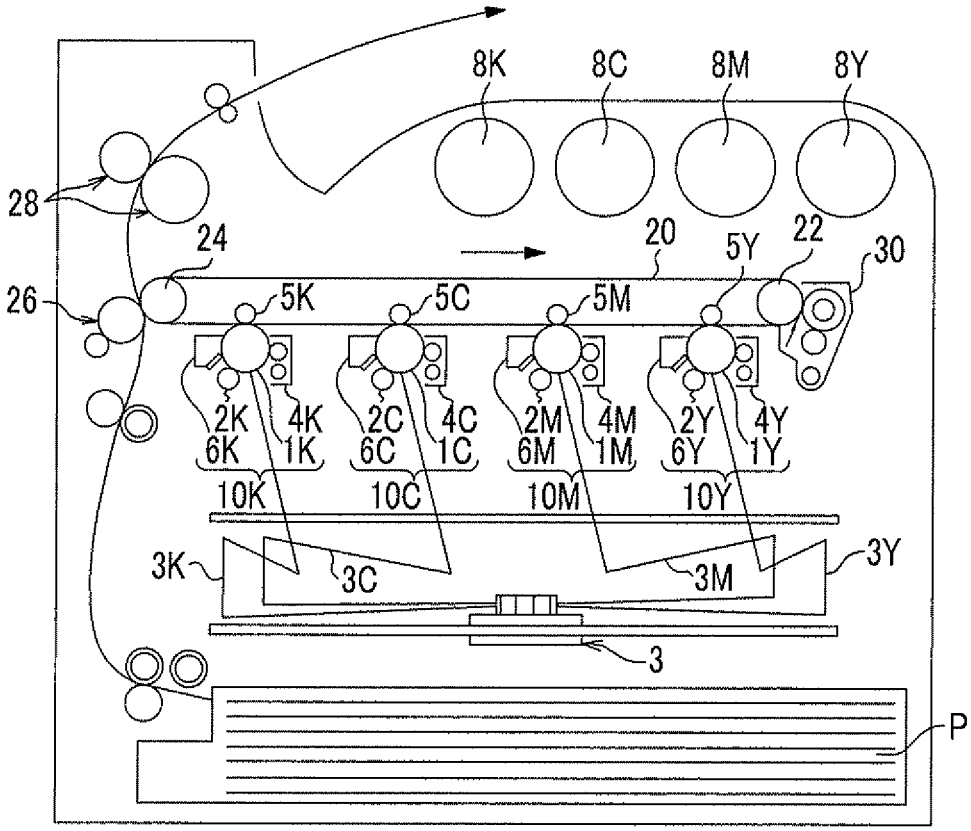
FIG. 1 is a schematic diagram showing a configuration of an example of an image forming apparatus according to an exemplary embodiment.

Hereinafter, an exemplary embodiment that is an example of the invention will be described.

Electrostatic Charge Image Developing Toner

An electrostatic charge image developing toner according to an exemplary embodiment (hereinafter, referred to as "toner") has toner particles and specific silica particles.

The specific silica particles have a titanium content ratio of from 0.001% by weight to 10% by weight in a surface layer thereof, an average silica particle diameter of from 30 nm to 500 nm, and a particle size distribution index of from 1.1 to 1.5, and a surface of a silica particle is surface-treated with a titanium compound in which an organic group is bonded to a titanium atom via an oxygen atom, and a hydrophobizing agent in sequence.

By virtue of the above-described configuration, the toner according to this exemplary embodiment suppresses the occurrence of white voids in the image.

The reason for this is not clear, but thought to be due to the following reason.

The specific silica particles having the volume average particle diameter and the particle size distribution index have characteristics in that the size is appropriate and the particle size distribution is uniform.

Since the specific silica particles have an appropriate size and a uniform particle size distribution, the adhesion between particles is smaller than in the case of a particle group having a wide particle size distribution, and thus it is thought that friction does not easily occur between particles. As a result, it is thought that the silica particles have excellent fluidity. Accordingly, the specific silica particles are thought to be attached to surfaces of the toner particles without uneven distribution.

Since the specific silica particles have an appropriate size and its surface has titanium having higher affinity to the toner particles than that of particles composed only of silica, it is thought that when the specific silica particles are attached to the toner particles, embedding into the toner particles and detaching do not easily occur.

Accordingly, the toner according to this exemplary embodiment is thought to suppress white voids in the image, that are caused due to separate transfer of detached specific silica particles to an electrostatic latent image holding member.

In addition, in the toner according to this exemplary embodiment, when release of the silica particles is suppressed, the silica particles are suppressed from being separately developed and remaining on the electrostatic latent image holding member, and thus the electrostatic latent image holding member easily obtains a target potential, and as a result, an image density fluctuation is thought to be suppressed.

In addition, in the toner according to this exemplary embodiment, since the surface layer of the specific silica particle appropriately includes titanium having high affinity to the toner particles with the above content ratio, a structure obtained by external addition to the toner particles is stabilized. The titanium in the surface layer of the specific silica particle maintains charging without lowering the resistance and improves charge exchangeability, and as a result, a reduction in the developability (particularly, a "fogging" phenomenon in which the toner is attached to a non-image part) is thought to be suppressed even when the amount of the specific silica particles externally added is increased.

Furthermore, in addition to the improvement in charge exchangeability of the toner by titanium, the silica particles have an appropriate size, and as a result, transferability is thought to be improved.

In addition, in the toner according to this exemplary embodiment, since the specific silica particles appropriately include titanium with the above content ratio, hygroscopicity is reduced as compared with the case of silica particles formed only of silicon oxide, that is, a fluctuation in the moisture holding amount is reduced even when the environment varies (for example, an environmental fluctuation between a high-temperature and high-humidity environment represented by summer and a low-temperature and low-humidity environment represented by winter), and thus it is thought that a variation in characteristics (variation in developability or transferability) is suppressed.

Particularly, in the toner according to this exemplary embodiment, when the specific silica particles are irregular so as to have an average circularity of from 0.5 to 0.85, it is thought that when the specific silica particles are attached to the toner particles, embedding into the toner particles, uneven distribution and detaching due to rolling, and destruction due to a mechanical load do not easily occur as compared with the case of a spherical shape (shape having an average circularity greater than 0.85). Accordingly, white voids are easily suppressed in the image.

Hereinafter, a configuration of the toner will be described in detail.

The toner is configured to include toner particles and silica particles as an external additive.

Toner Particles

The toner particles are configured to include, for example, a binder resin, and if necessary, a colorant, a release agent, and other additives.

Binder Resin

Examples of the binder resin include vinyl resins formed of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used singly or in combination of two or more kinds thereof.

A polyester resin is suitable as the binder resin.

A condensation polymer of a polyvalent carboxylic acid and a polyol is exemplified as the polyester resin. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained using "extrapolated glass transition onset temperature" described in the method of obtaining a glass transition temperature in "testing methods for transition temperatures of plastics" in JIS K-1987.

The weight average molecular weight (Mw) of the polyester resin is preferably from 5000 to 1000000, and more preferably from 7000 to 500000.

The number average molecular weight (Mn) of the polyester resin is preferably from 2000 to 100000.

The molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed using as a measuring device, GPC HLC-8120 manufactured by Tosoh Corporation, Column TSK gel Super HM-M (15 cm) manufactured by Tosoh Corporation, and a THF solvent. The weight average molecular weight and the number average molecular weight are calculated using a molecular weight calibration curve plotted from a monodisperse polystyrene standard sample from the results of the above measurement.

A known manufacturing method is used to manufacture the polyester resin. Specific examples thereof include a method of conducting a reaction at a polymerization temperature set to from 180° C. to 230° C., if necessary, under reduced pressure in the reaction system, while removing water or an alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be condensed and then polycondensed with the main component.

The content of the binder resin is, for example, preferably from 40% by weight to 95% by weight, more preferably from 50% by weight to 90% by weight, and even more preferably from 60% by weight to 85% by weight with respect to the entire toner particles.

Colorant

Examples of the colorant include various pigments such as carbon black, chrome yellow, Hansa yellow, benzidine yellow, thuren yellow, quinoline yellow, pigment yellow, permanent orange GTR, pyrazolone orange, Balkan orange, watch young red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more kinds thereof.

If necessary, the colorant may be surface-treated or used in combination with a dispersant. Plural kinds of colorants may be used in combination.

The content of the colorant is, for example, preferably from 1% by weight to 30% by weight, and more preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from a DSC curve obtained by differential scanning calorimetry (DSC) using "melting peak temperature" described in the method of obtaining a melting temperature in "testing methods for transition temperatures of plastics" in JIS K-1987.

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge control agent, and an inorganic powder. The toner particles include these additives as internal additives.

Characteristics of Toner Particles

The toner particles may have a single-layer structure, or a so-called core-shell structure composed of a core (core particle) and a coating layer (shell layer) that is coated on the core.

Here, toner particles having a core-shell structure may be composed of, for example, a core configured to include a binder resin, and if necessary, other additives such as a colorant and a release agent and a coating layer configured to include a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multi sizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of an aqueous solution of 5% surfactant (preferably sodium alkylbenzene sulfonate) as a dispersant. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a Coulter Multisizer II using an aperture having an aperture diameter of 100 μm. 50000 particles are sampled.

Cumulative distributions by volume and by number are drawn from the side of the smallest diameter on the basis of particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained using the following expression.

$$SF1=(ML^2/A)\times(\pi/4)\times 100 \qquad \text{Expression:}$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and calculated as follows. That is, an optical microscopic image of particles applied to a surface of a glass slide is input to an image analyzer Luzex through a video camera to obtain maximum lengths and projected areas of 100 particles, values of SF1 are calculated using the above expression, and an average value thereof is obtained.

External Additive

Specific silica particles are applied as an external additive.

Specific Silica Particles

The specific silica particles are particles that are formed of silicon oxide (silicon dioxide: silica) and surface-treated with a titanium compound, that is, particles in which a larger amount of titanium is present in a surface layer than in a central part of the silica particles.

The titanium content ratio of the surface layer of the specific silica particle is from 0.001% by weight to 10% by weight (preferably from 0.005% by weight to 2% by weight, and more preferably from 0.01% by weight to 1% by weight).

When the titanium content ratio is less than the above range, the specific silica particles detach from the toner particles, and the characteristics of the specific silica particles vary according to an environmental fluctuation.

On the other hand, when the titanium content ratio is greater than the above range, the titanium compound (particularly, tetraalkoxy titanium) vigorously reacts in the preparation of the specific silica particles, and as a result, a large amount of a coarse powder is generated, or a deterioration occurs in the particle size distribution and the shape, and thus a target particle size may not be obtained. Particularly, when a mechanical load is applied to the silica particles, the silica particles are easily lost, and thus it is difficult to improve flowing maintainability.

Here, the surface layer of a specific silica particle means a region inside the surface of the particle at a depth of 5 nm or less.

The titanium content ratio of the surface layer of the specific silica particles is a value measured as follows.

The value is obtained by an elemental analysis by X-ray photoelectron spectrometry after ion etching of the silica particles for 30 seconds at an accelerating voltage of 10 mV. The X-ray photoelectron spectrometry (XPS) is performed using JPS9000MX (manufactured by JEOL Ltd.) under conditions of an accelerating voltage of 20 kv, a current value of 10 mA, an Ar atmosphere, an accelerating voltage of 400±10 V, and a vacuum degree of $(3\pm1)\times10^{-2}$ Pa. From the obtained element amounts, the value is obtained using an expression: 100×titanium amount/(silicon amount+titanium amount).

Average Particle Diameter

The average particle diameter of the specific silica particles may be from 30 nm to 500 nm, preferably from 60 nm to 500 nm, more preferably from 100 nm to 350 nm, and even more preferably from 100 nm to 250 nm.

The average particle diameter is a volume average particle diameter of primary particles of the specific silica particles.

When the average particle diameter of the specific silica particles is less than 30 nm, the shape of the specific silica particles is easily changed to a spherical shape and the average circularity of the specific silica particles is difficult to be from 0.50 to 0.85. Whereby, even when the specific silica particles are irregular, it is difficult to suppress the specific silica particles from being buried into the toner particles, and thus it is difficult to realize the flowing maintainability of the toner particles.

On the other hand, in the case in which the average particle diameter of the specific silica particles is greater than 500 nm, when a mechanical load is applied to the silica particles, the silica particles are easily lost, and thus it is difficult to realize the flowing maintainability of the toner particles.

The average particle diameter of the specific silica particles means a 50%-diameter (D50v) in the cumulative frequency of the equivalent circle diameter obtained by observing 100 primary particles after external addition of the specific silica particles to the toner particles by the use of a scanning electron microscope (SEM) device and analyzing the image of the primary particles.

Particle Size Distribution Index

The particle size distribution index of the specific silica particles may be from 1.1 to 1.5, and preferably from 1.25 to 1.40.

The particle size distribution index is a particle size distribution index of primary particles of the specific silica particles.

It is difficult to manufacture silica particles in which the particle size distribution index of the specific silica particles is less than 1.1.

On the other hand, when the particle size distribution index of the specific silica particles is greater than 1.5, dispersibility to the toner particles deteriorates due to generation of coarse particles and a variation in particle diameter, and the amount of particles lost by a mechanical load increases with an increase in the amount of coarse particles. Accordingly, it is difficult to realize the flowing maintainability of the toner particles.

The particle size distribution index of the specific silica particles means a square root of the value obtained by dividing a 84%-diameter by a 16%-diameter in the cumulative frequency of the equivalent circle diameter obtained by observing 100 primary particles after external addition of the specific silica particles to the toner particles by the use of a SEM device and analyzing the image of the primary particles.

Average Circularity

The average circularity of the specific silica particles may be, for example, from 0.5 to 0.85 and preferably from 0.6 to 0.8.

The average circularity is an average circularity of primary particles of the specific silica particles.

When the average circularity of the specific silica particles is less than 0.5, the specific silica particles has a spherical shape having a high aspect ratio, and thus when a mechanical load is applied to the silica particles, stress concentration occurs and the particles are easily lost. Accordingly, in some cases, it is difficult to realize the flowing maintainability of the toner particles.

On the other hand, when the average circularity of the specific silica particles is greater than 0.85, the shape of the specific silica particles is close to a spherical shape. Therefore, the specific silica particles are not evenly attached due to a mechanical load of stirring in mixing with the toner particles, or not evenly attached after storage with the passage of time, and thus dispersibility to the toner particles deteriorates. In addition, in some cases, the specific silica particles easily detach from the toner particles.

Primary particles after external addition of the specific silica particles to the toner particles are observed by the use of a SEM device and the obtained image of the primary particles is analyzed to calculate a specific silica particle circularity "100/SF2" using the following expression.

$$\text{Circularity } (100/SF2)=4\pi\times(AI^2) \qquad \text{Expression:}$$

In the expression, I represents a boundary length of a primary particle on the image, and A represents a projected area of a primary particle.

The average circularity of the specific silica particles is obtained as a 50%-circularity in the cumulative frequency of the equivalent circle diameter of 100 primary particles, obtained by the above-described image analysis.

Specific Silica Particle Manufacturing Method

The specific silica particle manufacturing method is a manufacturing method for obtaining specific silica particles, and is specifically as follows.

The specific silica particle manufacturing method includes the steps of: preparing an alkali catalyst solution in which an alkali catalyst is contained in an alcohol-containing solvent; forming silica particles by supplying tetraalkoxysilane and an alkali catalyst to the alkali catalyst; surface-treating the silica particles with a titanium compound by adding a mixture of the titanium compound in which an organic group is bonded to a titanium atom via an oxygen atom and an alcohol to the alkali catalyst solution containing the formed silica particles; and surface-treating, with a hydrophobizing agent, the silica particles surface-treated with the titanium compound (hereinafter, referred to as "hydrophobizing treatment").

That is, the specific silica particle manufacturing method is a method of obtaining specific silica particles, including: supplying an alcohol diluted solution, in which a titanium compound is diluted with an alcohol, to a solution containing silica particles formed by a sol-gel method to surface-treat the silica particles with the titanium compound; and subjecting the surfaces of the silica particles surface-treated with the titanium compound to a hydrophobizing treatment with a hydrophobizing agent.

In the specific silica particle manufacturing method, specific silica particles having the above-described characteristics are obtained by the above-described method. The reason for this is not clear, but thought to be that in the surface treatment with a titanium compound, since a single titanium compound is not used, but an alcohol diluted solution in which the titanium compound is diluted with an alcohol is used, the titanium compound relatively uniformly reacts without reacting in a specific region, and thus the occurrence of aggregation is suppressed and specific silica particles having the above-described target particle diameter and particle size distribution are thus formed.

Here, in the specific silica particle manufacturing method, the sol-gel method for forming silica particles is not particularly limited, and a known method is employed.

On the other hand, the following method may be employed in order to obtain particularly irregular silica particles among the specific silica particles.

Hereinafter, a method of manufacturing the irregular silica particles will be referred to as "specific silica particle manufacturing method" and described.

The specific silica particle manufacturing method is a method of manufacturing irregular specific silica particles, including the steps of: preparing an alkali catalyst solution in which an alkali catalyst is contained at a concentration of from 0.6 mol/L to 0.85 mol/L in an alcohol-containing solvent; forming silica particles by supplying, to the alkali catalyst solution, tetraalkoxysilane in a supply amount of from 0.001 mol/(mol·min) to 0.01 mol/(mol·min) with respect to the alcohol and supplying an alkali catalyst in an amount of from 0.1 mol to 0.4 mol per 1 mol of the total supply amount of the tetraalkoxysilane that is supplied per minute; surface-treating the silica particles with a titanium compound by supplying a mixture of the titanium compound in which an organic group is bonded to a titanium atom via an oxygen atom and an alcohol to the alkali catalyst solution containing the formed silica particles; and hydrophobizing the surfaces of the silica particles surface-treated with the titanium compound by a hydrophobizing agent.

That is, the specific silica particle manufacturing method is a method of obtaining specific silica particles, in which while tetraalkoxysilane that is a raw material and an alkali catalyst that is a catalyst are separately supplied in the presence of an alcohol containing an alkali catalyst at the above concentration so that the above-described relationship therebetween is satisfied, the tetraalkoxysilane is reacted to form silica particles, and then a mixture of a titanium compound and an alcohol is added to the solution containing the silica particles formed therein to surface-treat the silica particles with the titanium compound, and the silica particles surface-treated with the titanium compound are then subjected to a hydrophobizing treatment with a hydrophobizing agent.

In the specific silica particle manufacturing method, irregular specific silica particles are obtained by the above-described method with only a small amount of coarse aggregates. The reason for this is not clear, but thought to be as follows.

First, when an alkali catalyst solution in which an alkali catalyst is contained in an alcohol-containing solvent is prepared, and tetraalkoxysilane and an alkali catalyst are supplied to the solution, the tetraalkoxysilane supplied to the alkali catalyst solution is reacted and core particles are formed. At this time, when the alkali catalyst concentration in the alkali catalyst solution is in the above range, it is thought that the formation of coarse aggregates such as secondary aggregates is suppressed and irregular core particles are formed. The reason for this is thought to be that the alkali catalyst is coordinated on the surfaces of the formed core particles as well as causing a catalytic action to contribute to the shape and dispersion stability of the core particles, but when the amount of the alkali catalyst is in the above range, the alkali catalyst does not uniformly cover the surfaces of the core particles (that is, the alkali catalyst is not evenly attached to the surfaces of the core particles), and thus the dispersion stability of the core particles is maintained, but partial deviation occurs in surface tension and chemical affinity of the core particles and irregular core particles are formed.

In addition, when the tetraalkoxysilane and the alkali catalyst are continuously supplied, the formed core particles are grown due to the reaction of the tetraalkoxysilane, and silica particles are obtained.

It is thought that by supplying the tetraalkoxysilane and the alkali catalyst while maintaining the supply amounts thereof to satisfy the above-described relationship therebetween, the formation of coarse aggregates such as secondary aggregates is suppressed, irregular core particles are grown while the irregular shape thereof is maintained, and as a result, irregular silica particles are formed. The reason for this is thought to be that by satisfying the above-described relationship between the supply amounts of the tetraalkoxysilane and the alkali catalyst, the dispersion of the core particles is maintained and partial deviation in tension and chemical affinity of the surfaces of the core particles is maintained, whereby the core particles are grown while maintaining the irregular shape.

Here, it is thought that the supply amount of tetraalkoxysilane relates to the particle size distribution and the circularity of silica particles. It is thought that by adjusting the supply amount of tetraalkoxysilane to from 0.001 mol/(mol·min) to 0.01 mol/(mol·min) with respect to the alcohol, the probability of contact between the dripped tetraalkoxysilane and the core particles is lowered, and thus the tetraalkoxysilane is evenly supplied to the core particles before the reaction of the tetraalkoxysilane therebetween. Accordingly, it is thought that the tetraalkoxysilane may be reacted with the core particles without deviation. As a result, it is thought that a variation in particle growth is suppressed and silica particles having a narrow distribution width may be manufactured.

It is thought that the average particle diameter of the silica particles depends on the total supply amount of the tetraalkoxysilane.

In addition, the silica particles obtained in this manner are subjected to a surface treatment with a titanium compound and a surface treatment with a hydrophobizing agent in sequence.

From the above description, in the specific silica particle manufacturing method, it is thought that irregular specific silica particles are obtained.

In addition, in the specific silica particle manufacturing method, since it is thought that irregular core particles are formed and grown while maintaining the irregular shape thereof and silica particles are thus formed, it is thought that irregular specific silica particles having high shape stability with respect to a mechanical load are obtained.

In addition, in the specific silica particle manufacturing method, since it is thought that the formed irregular core particles are grown while maintaining the irregular shape and silica particles are thus obtained, it is thought that specific silica particles that have strong resistance to a mechanical load and are thus not easily broken are obtained.

In addition, in the specific silica particle manufacturing method, since particles are formed by supplying tetraalkoxysilane and an alkali catalyst to an alkali catalyst solution and reacting the tetraalkoxysilane, the total alkali catalyst amount to be used is reduced as compared with the case of manufacturing irregular silica particles by a conventional sol-gel method, and as a result, omission of the alkali catalyst removing step is also realized. This is particularly favorable when the specific silica particles are applied to products requiring high purity.

First, the alkali catalyst solution preparation step will be described.

In the alkali catalyst solution preparation step, an alcohol-containing solvent is prepared, and an alkali catalyst is added thereto to prepare an alkali catalyst solution.

The alcohol-containing solvent may be a single alcohol solvent, or if necessary, a mixed solvent with other solvents such as water; ketones such as acetone, methyl ethyl ketone, and methyl isobutyl ketone; cellosolves such as methyl cellosolve, ethyl cellosolve, butyl cellosolve, and cellosolve acetate; and ethers such as dioxane and tetrahydrofuran. In the case of the mixed solvent, the amount of the alcohol with respect to other solvents may be 80% by weight or greater and preferably 90% by weight or greater.

Examples of the alcohol include lower alcohols such as methanol and ethanol.

The alkali catalyst is a catalyst for promoting the reaction (hydrolysis reaction, condensation reaction) of tetraalkoxysilane, and examples thereof include basic catalysts such as ammonia, urea, monoamine, and quaternary ammonium salt, and particularly, ammonia is preferable.

The concentration (content) of the alkali catalyst may be from 0.6 mol/L to 0.85 mol/L, preferably from 0.63 mol/L to 0.78 mol/L, and more preferably from 0.66 mol/L to 0.75 mol/L.

When the concentration of the alkali catalyst is less than 0.6 mol/L, the dispersibility of core particles in the course of growing the formed core particles becomes unstable, and thus coarse aggregates such as secondary aggregates are formed or gelation occurs, whereby in some cases, the particle size distribution deteriorates.

On the other hand, when the concentration of the alkali catalyst is greater than 0.85 mol/L, the stability of the formed core particles excessively increases, and thus completely spherical core particles are formed and irregular core particles having an average circularity of 0.85 or less may not be obtained. As a result, irregular silica particles may not be obtained.

The concentration of the alkali catalyst is a concentration with respect to an alcohol catalyst solution (alkali catalyst+alcohol-containing solvent).

Next, the particle forming step will be described.

The particle forming step is a step in which tetraalkoxysilane and an alkali catalyst are supplied to an alkali catalyst solution, and the tetraalkoxysilane is reacted (hydrolysis reaction, condensation reaction) in the alkali catalyst solution to form silica particles.

In this particle forming step, core particles are formed due to the reaction of the tetraalkoxysilane at an initial period of the supply of the tetraalkoxysilane (core particle forming stage), and then silica particles are formed through the growth of the core particles (core particle growing stage).

Here, examples of the tetraalkoxysilane include tetramethoxysilane, tetraethoxysilane, tetrapropoxysilane, and tetrabutoxysilane. Tetramethoxysilane and tetraethoxysilane may be preferably used from the viewpoint of controllability of the reaction rate, and the shape, particle diameter, particle size distribution and the like of the obtained specific silica particles.

The supply amount of the tetraalkoxysilane is from 0.001 mol/(mol·min) to 0.01 mol/(mol·min), preferably from 0.002 mol/(mol·min) to 0.009 mol/(mol·min), and more preferably from 0.003 mol/(mol·min) to 0.008 mol/(mol·min) with respect to the alcohol in the alkali catalyst solution. This means that the tetraalkoxysilane is supplied in a supply amount of from 0.001 mol to 0.01 mol per minute with respect to 1 mol of the alcohol used in the step of preparing the alkali catalyst solution.

Although the particle diameter of the specific silica particles depends on the kind of the tetraalkoxysilane and the reaction conditions, when the total supply amount of the tetraalkoxysilane that is used in the particle forming reaction is adjusted to, for example, 1.08 mol or greater with respect to 1 L of the silica particle dispersion, primary particles having a particle diameter of 100 nm or greater are obtained, and when the total supply amount of the tetraalkoxysilane is adjusted to 5.49 mol or less with respect to 1 L of the silica particle dispersion, primary particles having a particle diameter of 500 nm or less are obtained.

When the supply amount of the tetraalkoxysilane is less than 0.001 mol/(mol·min), the probability of contact between the dripped tetraalkoxysilane and the core particles is reduced. However, a long period of time is required until dripping of the total supply amount of the tetraalkoxysilane ends, and production efficiency deteriorates.

It is thought that when the supply amount of the tetraalkoxysilane is 0.01 mol/(mol·min) or greater, the reaction of the tetraalkoxysilane occurs therebetween before the reaction of the dripped tetraalkoxysilane with the core particles. Therefore, uneven supply of the tetraalkoxysilane to the core particles is facilitated and a variation in the formation of the core particles is caused, and thus the average particle diameter and the distribution width of the shape distribution increase.

Meanwhile, the above-described example is exemplified as the alkali catalyst that is supplied to the alkali catalyst solution. The alkali catalyst to be supplied may be the same kind as or a different kind from the alkali catalyst that is contained in advance in the alkali catalyst solution, but the same kind is preferably used.

The supply amount of the alkali catalyst is from 0.1 mol to 0.4 mol, preferably from 0.14 mol to 0.35 mol, and more preferably from 0.18 mol to 0.30 mol per 1 mol of the total supply amount of the tetraalkoxysilane that is supplied per minute.

When the supply amount of the alkali catalyst is less than 0.1 mol, the dispersibility of core particles in the course of growing the formed core particles becomes unstable, and thus coarse aggregates such as secondary aggregates are formed or gelation occurs, whereby in some cases, the particle size distribution deteriorates.

On the other hand, when the supply amount of the alkali catalyst is greater than 0.4 mol, the stability of the formed core particles excessively increases, and thus even when irregular core particles are formed in the core particle forming stage, the core particles are grown into a spherical shape in the core particle growing stage, and irregular silica particles may not be obtained.

Here, in the particle forming step, tetraalkoxysilane and an alkali catalyst are supplied to an alkali catalyst solution, but this supply method may be a continuous supply method or an intermittent supply method.

In addition, in the particle forming step, the temperature (temperature at the time of supply) in the alkali catalyst solution may be, for example, from 5° C. to 50° C., and is preferably from 15° C. to 40° C.

Next, the surface treatment step with a titanium compound will be described.

The surface treatment step is a step of surface-treating the silica particles with a titanium compound by supplying a mixture of the titanium compound and an alcohol to an alkali catalyst solution containing the silica particles formed through the above-described step.

Specifically, for example, the silica particles are surface-treated with a titanium compound by reacting an organic group (e.g., alkoxy group) of the titanium compound with a silanol group of the surfaces of the silica particles.

Here, the titanium compound is a metal compound in which a titanium atom is bonded to an organic group via oxygen, and examples thereof include titanium compounds of alkoxides (e.g., methoxide, ethoxide, n-propoxide, i-propoxide, n-butoxide, i-butoxide, sec-butoxide, and tert-butoxide), chelates or acylates (e.g., β-diketones such as acetylacetonato; β-ketoesters such as ethyl acetoacetate; amines such as triethanolamine; and carboxylic acids such as acetic acid, butyric acid, lactic acid, and citric acid).

However, the titanium compound may preferably be a titanium compound having one or more (preferably two or more) alkoxy groups from the viewpoint of controllability of the reaction rate, and the shape, particle diameter, particle size distribution and the like of the obtained specific silica particles. That is, the titanium compound may preferably be a titanium compound in which one or more (preferably two or more) alkoxy groups (alkyl groups that are bonded to a titanium atom via oxygen) are bonded to a titanium atom.

The number of carbon atoms of the alkoxy group may be 8 or less, and is preferably from 3 to 8 from the viewpoint of controllability of the reaction rate, and the shape, particle diameter, particle size distribution and the like of the obtained specific silica particles.

Specific examples of the titanium compound include tetra-i-propoxytitanium, tetra-n-butoxytitanium, tetra-t-butoxytitanium, di-i-propoxy.bis(ethyl acetoacetate)titanium, di-i-propoxy.bis(acetylacetonato) titanium, di-i-propoxy.bis (triethanolaminato)titanium, di-i-propoxytitanium.diacetate, and di-i-propoxytitanium.dipropionate.

Examples of the alcohol include alcohols having from 1 to 6 carbon atoms (preferably 1 to 4 carbon atoms), and specific examples thereof include methanol, ethanol, propanol, isopropanol, butanol, tert-butyl alcohol, pentanol, hexanol, and cyclohexanol.

Particularly, the alcohol may preferably be an alcohol having a smaller number of carbon atoms than that of the alkoxy group of the titanium compound (specifically, for example, the difference in the number of carbon atoms is from 1 to 4) from the viewpoint of controllability of the reaction rate of the titanium compound, and the shape, particle diameter, particle size distribution and the like of the obtained specific silica particles.

The alcohol may be the same kind as or a different kind from the alcohol that is contained in the alkali catalyst solution.

In the mixture of the titanium compound and the alcohol, the concentration of the titanium compound may be from 0.1% by weight to 5% by weight, and is preferably from 0.5% by weight to 2% by weight with respect to the alcohol.

The mixture of the titanium compound and the alcohol may preferably be supplied so that for example, the ratio of the titanium compound to the silica particles is from 1% by weight to 10% by weight.

When the supply amount of the mixture is in the above range, the reaction rate of the titanium compound is controlled, gelation is easily suppressed, and the target titanium content ratio, shape, particle diameter, and particle size distribution of the specific silica particles are easily obtained.

The conditions of the surface treatment of the silica particles with the titanium compound are not particularly limited. For example, the surface treatment is performed by reacting the titanium compound at a temperature of from 25° C. to 90° C. under stirring.

Silica particles surface-treated with a titanium compound are obtained through the above steps.

In this state, the silica particles are obtained in a state of a dispersion, but the process may proceed to a hydrophobizing treatment in a state in which the silica particles are still in a state of a silica particle dispersion, or in a state in which the silica particles are turned into a powder by removing the solvent.

When the process proceeds to a hydrophobizing treatment in a state in which the silica particles are in a state of a silica particle dispersion, if necessary, the concentration of the solid content of the specific silica particles may be adjusted through dilution with water or an alcohol or concentration. In addition, the silica particle dispersion may be used after solvent substitution with an aqueous organic solvent such as other alcohols, esters, and ketones.

On the other hand, when the process proceeds to a hydrophobizing treatment in a state in which the silica particles are turned into a powder, it is necessary to remove the solvent from the silica particle dispersion. As a solvent removing method, known methods such as 1) a method including: removing a solvent by filtration, centrifugal separation, distillation or the like; and drying using a vacuum dryer, a tray dryer or the like, and 2) a method of directly drying a slurry using a fluidized bed dryer, a spray dryer, or the like are exemplified. The drying temperature is not particularly limited, and is preferably 200° C. or lower. When the drying temperature is higher than 200° C., primary particles are easily bonded to each other due to the condensation of the silanol groups remaining on the surfaces of the specific silica particles, or coarse particles are easily generated.

If necessary, the dried silica particles may be ground or sieved to remove coarse particles or aggregates. The grinding method is not particularly limited, and performed using, for example, a dry pulverizer such as a jet mill, vibration mill, a ball mill, or a pin mill. The sieving method is performed by a known apparatus such as vibration sieve, wind classifier, or the like.

Next, the hydrophobizing treatment step with a hydrophobizing agent will be described.

In the hydrophobizing step, the silica particles surface-treated with the titanium compound through the above-described step is subjected to a hydrophobizing treatment with a hydrophobizing agent.

Examples of the hydrophobizing agent include known organic silicon compounds having an alkyl group (e.g., methyl group, ethyl group, propyl group, and butyl group), and specific examples thereof include silazane compounds (e.g., silane compounds such as methyltrimethoxysilane, dimethyldimethoxysilane, trimethylchlorosilane, and trimethylmethoxysilane, hexamethyldisilazane, and tetramethyldisilazane). As the hydrophobizing agent, one or two or more kinds may be used.

Among these hydrophobizing agents, organic silicon compounds having a trimethyl group, such as trimethylmethoxysilane and hexamethyldisilazane are preferable.

The amount of the hydrophobizing agent to be used is not particularly limited. However, in order to obtain an effect of hydrophobization, the amount is, for example, from 1% by weight to 100% by weight, and preferably from 5% by weight to 80% by weight with respect to the silica particles.

Examples of the method of obtaining a specific silica particle dispersion subjected to the hydrophobizing treatment with a hydrophobizing agent include a method of obtaining a specific silica particle dispersion, in which a necessary amount of a hydrophobizing agent is added to a silica particle dispersion subjected to a surface treatment with a titanium compound to conduct a reaction at a temperature of from 30° C. to 80° C. under stirring to thereby subject silica particles to a hydrophobizing treatment. When the reaction temperature is lower than 30° C., the hydrophobizing reaction does not easily proceed, and when the reaction temperature is higher than 80° C., gelation of the dispersion or aggregation of the silica particles due to the self condensation of the hydrophobizing agent may easily occur.

Examples of the method of obtaining powdery specific silica particles include a method in which a specific silica particle dispersion is obtained using the above-described method, and then dried using the above-described method, thereby obtaining powdery specific silica particles, a method in which powdery silica particles are obtained by drying a silica particle dispersion subjected to a surface treatment with a titanium compound, and then a hydrophobizing agent is added thereto to perform a hydrophobizing treatment, thereby obtaining powdery specific silica particles, and a method in which a specific silica particle dispersion is obtained by performing a hydrophobizing treatment once, and then dried to obtain powdery specific silica particles, and then a hydrophobizing agent is added thereto to perform a hydrophobizing treatment, thereby obtaining powdery specific silica particles.

Here, examples of the method of subjecting the powdery silica particles to a hydrophobizing treatment include a method in which powdery silica particles are stirred in a treatment tank such as a Henschel mixer or a fluidized bed, a hydrophobizing agent is added thereto, and the inside of the treatment tank is heated to gasify the hydrophobizing agent, thereby conducting a reaction with a silanol group on the surfaces of the powdery silica particles. The treatment temperature is not particularly limited, but may be, for example, from 80° C. to 300° C., and is preferably from 120° C. to 200° C.

The above-described silica particles as an external additive are added in an amount of preferably from 0.5 part by weight to 5.0 parts by weight, more preferably from 0.7 part by weight to 4.0 parts by weight, and even more preferably from 0.9 part by weight to 3.5 parts by weight with respect to 100 parts by weight of the toner particles.

Toner Manufacturing Method

Next, a method of manufacturing a toner according to this exemplary embodiment will be described.

The toner according to this exemplary embodiment is obtained by externally adding an external additive to toner particles after manufacturing of the toner particles.

The toner particles may be manufactured using any one of a dry manufacturing method (e.g., kneading and pulverization method) and a wet manufacturing method (e.g., aggregation and coalescence method, suspension and polymerization method, and dissolution and suspension method). The toner particle manufacturing method is not particularly limited to these manufacturing methods, and a known manufacturing method is employed.

Among these, the toner particles are preferably obtained by an aggregation and coalescence method.

Specifically, for example, when the toner particles are manufactured by an aggregation and coalescence method, the toner particles are manufactured through the steps of: preparing a resin particle dispersion in which resin particles as a binder resin are dispersed (resin particle dispersion preparation step); aggregating the resin particles (if necessary, other particles) in the resin particle dispersion (if necessary, in the dispersion after mixing with other particle dispersions) to form aggregated particles (aggregated particle forming step); and heating the aggregated particle dispersion in which the aggregated particles are dispersed, to coalesce the aggregated particles, thereby forming toner particles (coalescence step).

Hereinafter, the respective steps will be described in detail.

In the following description, a method of obtaining toner particles containing a colorant and a release agent will be described. However, the colorant and the release agent are used if necessary. Additives other than the colorant and the release agent may be used.

Resin Particle Dispersion Preparation Step

First, for example, a colorant particle dispersion in which colorant particles are dispersed and a release agent dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium that is used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as sulfate-based, sulfonate-based, phosphate-based, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyol-based nonionic surfactants. Among these, anionic surfactants and cationic surfactants are particularly preferable. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, for example, common dispersing methods using, for example, a rotary shearing-type homogenizer, a ball mill having media, a sand mill, and a Dyno mill are exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); converting the resin (so-called phase inversion) from W/O to O/W by adding an aqueous medium (W phase) to form a discontinuous phase, thereby dispersing the resin as particles in the aqueous medium.

The volume average particle diameter of the resin particles that are dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, manufactured by Horiba, Ltd. LA-700), and a particle diameter when the cumulative percentage becomes 50% with respect to the entire particles is measured as a volume average particle diameter D50p. The volume average particle diameter of the particles in other dispersions is also measured in the same manner.

The content of the resin particles that are contained in the resin particle dispersion is, for example, preferably from 5% by weight to 50% by weight, and more preferably from 10% by weight to 40% by weight.

For example, the colorant dispersion and the release agent dispersion are also prepared in the same manner as in the case of the resin particle dispersion. That is, the particles in the resin particle dispersion are the same as the colorant particles that are dispersed in the colorant dispersion and the release agent particles that are dispersed in the release agent dispersion, in terms of the volume average particle diameter, the dispersion medium, the dispersing method, and the content of the particles.

Aggregated Particle Forming Step

Next, the colorant particle dispersion and the release agent dispersion are mixed together with the resin particle dispersion.

The resin particles, the colorant particles, and the release agent particles are heterogeneously aggregated in the mixed dispersion to form aggregated particles with a diameter near a target toner particle diameter that include the resin particles, the colorant particles, and the release agent particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated at a glass transition temperature of the resin particles (specifically, for example, from a temperature lower than glass transition temperature of the resin particles by 30° C. to a temperature lower than glass transition temperature by 10° C.) to aggregate the particles dispersed in the mixed dispersion, thereby forming the aggregated particles.

In the aggregated particle forming step, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity of the polarity of the surfactant that is used as the dispersant to be added to the mixed dispersion, such as inorganic metal salts and di- or higher-valent metal complexes. Particularly, when a metal complex is used as the aggregating agent, the amount of the surfactant to be used is reduced and charging characteristics are improved.

If necessary, an additive may be used that forms a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, preferably from 0.01 part by weight to 5.0 parts by weight, and more preferably from 0.1 part by weight to less than 3.0 parts by weight with respect to 100 parts by weight of the resin particles.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by from 10° C. to 30° C.) to coalesce the aggregated particles and form toner particles.

Toner particles are obtained through the above steps.

After the aggregated particle dispersion in which the aggregated particles are dispersed is obtained, toner particles may be manufactured through the steps of: further mixing the resin particle dispersion in which the resin particles are dispersed with the aggregated particle dispersion to conduct aggregation so that the resin particles are further attached to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

Here, after the coalescence step ends, the toner particles formed in the solution are subjected to a washing step, a solid-liquid separation step, and a drying step, that are well known, and thus dry toner particles are obtained.

In the washing step, preferably, displacement washing with ion exchange water may be sufficiently performed from the viewpoint of charging properties. In addition, the solid-liquid separation step is not particularly limited, but suction filtration, pressure filtration, or the like may be preferably performed from the viewpoint of productivity. Furthermore, the method for the drying step is also not particularly limited, but freeze drying, flash jet drying, fluidized drying, vibration-type fluidized drying, or the like may be preferably performed from the viewpoint of productivity.

The toner according to this exemplary embodiment is manufactured by, for example, adding an external additive to dry toner particles that have been obtained, and mixing them. The mixing may be preferably performed with, for example, a V-blender, a Henschel mixer, a Loedige mixer, or the like. Furthermore, if necessary, coarse toner particles may be removed using a vibrating sieving machine, a wind classifier, or the like.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a conductive particle dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluidized bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including: a charging step of charging a surface of an image holding member; an electrostatic charge image forming step of forming an electrostatic charge image on a charged surface of the image holding member; a developing step of developing the electrostatic charge image formed on the surface of the image holding member with the electrostatic charge image developer according to this exemplary embodiment to form a toner image; a transfer step of transferring the toner image formed on the surface of the image holding member onto a surface of a recording medium; and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image, a surface of an image holding member before charging; or an apparatus that is provided with an erasing unit that irradiates, after transfer of a toner image and before charging, a surface of an image holding member with erase light for erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachably mounted on the image forming apparatus. As the process cartridge, for example, a process cartridge that contains the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawings will be described, but descriptions of other parts will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachably mounted on the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with four color toners, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration. Here, the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member, Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges to stay on a part to which the laser beams 3Y are not applied.

The electrostatic charge image that is formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically attached to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) of the toner polarity (−), and is controlled to +10 μA, for example, in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like, and as a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge and Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on an image holding member with the electrostatic charge image developer to form a toner image, and is detachable from an image forming apparatus.

The process cartridge according to this exemplary embodiment is not limited to the above-described configuration, and may be configured to include a developing device 111, and if necessary, one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawings will be described, but descriptions of other parts will be omitted.

Figure 2:
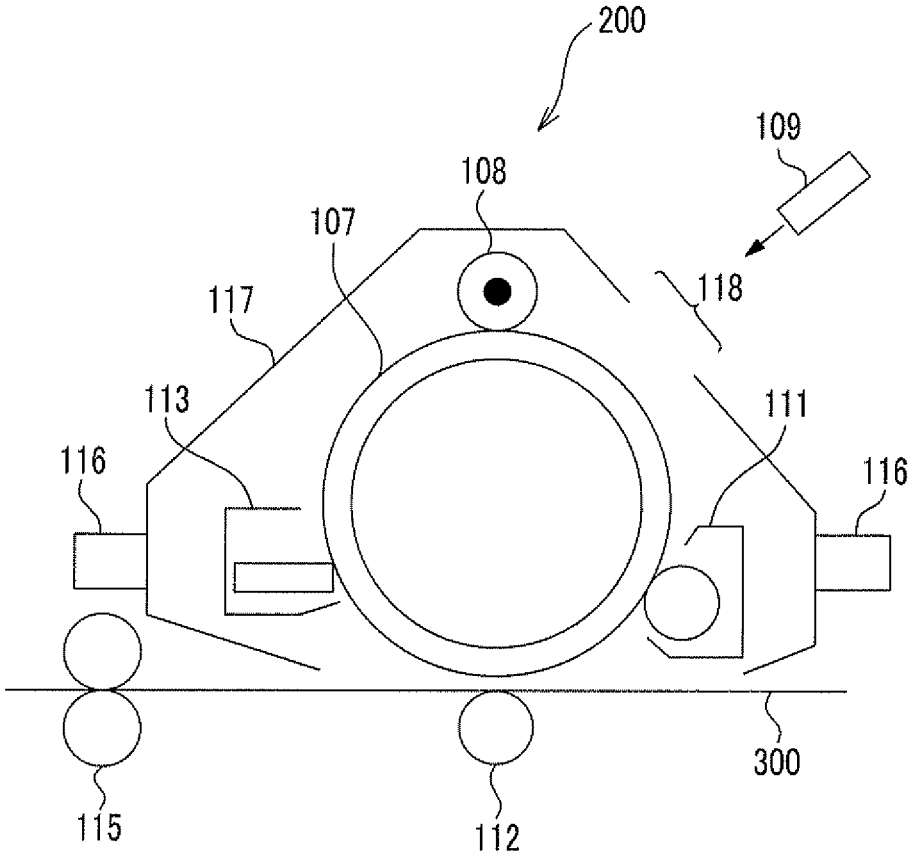
FIG. 2 is a schematic diagram showing a configuration of an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge with a configuration in which a photoreceptor 107 (an example of the image holding member), a charging roll 108 (an example of the charging device) provided around the photoreceptor 107, a developing device 111 (an example of the developing device), and a photoreceptor cleaning device 113 (an example of the cleaning unit) are integrally combined and held by, for example, a casing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge that accommodates the electrostatic charge image developing toner according to this exemplary embodiment and is detachable from an image forming apparatus. The toner cartridge accommodates an electrostatic charge image developing toner for replenishment for being supplied to the developing unit provided in the image forming apparatus.

The image forming apparatus shown in FIG. 1 has a configuration in which the toner cartridges 8Y, 8M, 8C, and 8K are detachably mounted thereon, and the developing devices 4Y, 4M, 4C, and 4K are connected to the toner cartridges corresponding to the respective developing devices (colors) via toner supply tubes (not shown), respectively. In addition, when the toner contained in the toner cartridge runs low, the toner cartridge is replaced.

EXAMPLES

Hereinafter, this exemplary embodiment will be described in more detail using examples, but is not limited to these examples. In the following description, unless specifically noted, "parts" and "%" mean "parts by weight" and "% by weight", respectively.

Preparation of Toner Particles

Toner Particles

Preparation of Polyester Resin Particle Dispersion

Ethylene Glycol (manufactured by Wako Pure Chemical Industries, Ltd.): 37 parts

Neopentyl Glycol (manufactured by Wako Pure Chemical Industries, Ltd.): 65 parts 1,9-Nonanediol (manufactured by Wako Pure Chemical Industries, Ltd.): 32 parts Terephthalic Acid (manufactured by Wako Pure Chemical Industries, Ltd.): 96 parts The above monomers are charged into a flask, and the temperature is increased to 200° C. over 1 hour. After confirming that stirring is performed in the reaction system, 1.2 parts of dibutyltin oxide is added. Furthermore, while distilling away generated water, the temperature is increased from 200° C. to 240° C. over 6 hours to further continue the dehydration condensation reaction for 4 hours at 240° C., thereby obtaining a polyester resin A having an acid value of 9.4 mgKOH/g, a weight average molecular weight of 13,000, and a glass transition temperature of 62° C.

Next, while being in a melt state, the polyester resin A is transferred to a Cavitron CD1010 (manufactured by Eurotec, Ltd.) at a rate of 100 parts/min, Diluted ammonia aqueous solution having a concentration of 0.37% that is obtained by diluting reagent ammonia aqueous solution with ion exchange water is put into a separately provided aqueous medium tank, and transferred to the Cavitron together with the polyester resin melt at a rate of 0.1 L/min while being heated at 120° C. with a heat exchanger. The Cavitron is operated under conditions of a rotor rotation speed of 60 Hz and a pressure of 5 kg/cm$^2$, thereby obtaining a polyester resin particle dispersion in which resin particles having a volume average particle diameter of 160 nm, a solid content of 30%, a glass transition temperature of 62° C., and a weight average molecular weight Mw of 13,000 are dispersed.

Preparation of Colorant Particle Dispersion

Cyan Pigment (Pigment Blue 15:3, manufactured by Dainichiseika Color & Chemicals Mfg. Co., Ltd.): 10 parts Anionic Surfactant (Neogen SC, Dai-Ichi Kogyo Seiyaku Co., Ltd.): 2 parts Ion Exchange Water: 80 parts The above components are mixed with each other and dispersed for 1 hour using a high-pressure impact-type disperser Ultimizer (HJP30006, manufactured by Sugino Machine, Ltd.), thereby obtaining a colorant particle dispersion having a volume average particle diameter of 180 nm and a solid content of 20%.

Preparation of Release Agent Particle Dispersion

Carnauba Wax (RC-160, melting temperature: 84° C., manufactured by Toakasei Co., Ltd.): 50 parts Anionic Surfactant (Neogen SC, manufactured by Dai-Ichi Kogyo Seiyaku Co., Ltd.): 2 parts Ion Exchange Water: 200 parts The above components are heated at 120° C. and mixed and dispersed by Ultra Turrax T50 manufactured by IKA-Werke GmbH & Co. KG. Then, a dispersion treatment is performed by a pressure discharge-type homogenizer, thereby obtaining a release agent particle dispersion having a volume average particle diameter of 200 nm and a solid content of 20%.

Preparation of Toner Particles

Polyester Resin Particle Dispersion: 200 parts

Colorant Particle Dispersion: 25 parts

Release Agent Particle Dispersion: 30 parts

Polyaluminum Chloride: 0.4 part

Ion Exchange Water: 100 parts

The above components are added into a stainless-steel flask, and mixed and dispersed using an Ultra Turrax manufactured by IKA-Werke GmbH & Co. KG. Then, while being stirred in an oil bath for heating, the flask is heated to 48° C. After holding for 30 minutes at 48° C., 70 parts of a polyester resin particle dispersion, that is the same as the above polyester resin particle dispersion, is added to the flask.

Thereafter, the pH in the system is adjusted to 8.0 using aqueous sodium hydroxide solution having a concentration of 0.5 mol/L. Then, the stainless-steel flask is sealed and heated to 90° C. while being continuously stirred with a stirring shaft that is magnetically sealed, followed by holding for 3 hours. After the reaction ends, the obtained material is cooled at a rate of temperature decrease of 2° C./min, filtered, and washed with ion exchange water. Then, solid-liquid separation is performed through Nutsche-type suction filtration. The obtained material is further redispersed using 3 L of ion exchange water at 30° C., and stirred and washed at 300 rpm for 15 minutes. This washing operation is further repeated six times, and when the filtrate has a pH of 7.54 and an electrical conductivity of 6.5 μS/cm, solid-liquid separation is performed through Nutsche-type suction filtration using No. 5A filter paper. Next, vacuum drying is continued for 12 hours, thereby obtaining toner particles.

A result of measuring a volume average particle diameter D50v of the toner particles 1 by a Coulter counter is 5.8 μm and a SF1 is 130.

Preparation of External Additive

Silica Particles A1

Alkali Catalyst Solution Preparation Step (Preparation of Alkali Catalyst Solution)

400 parts of methanol and 66 parts of 10% ammonia aqueous solution ($NH_4OH$) are put into a glass reaction container having a volume of 2.5 L and equipped with a stirring blade, a dropping nozzle, and a thermometer, and are mixed by stirring to obtain an alkali catalyst solution. At this time, an ammonia catalyst amount, i.e., an $NH_3$ amount in the alkali catalyst solution ($NH_3$ (mol)/($NH_3$+methanol+water) (L)) is 0.68 mal/L.

Particle Forming Step (Preparation of Silica Particle Suspension)

Next, the temperature of the alkali catalyst solution is adjusted to 25° C., and the alkali catalyst solution is subjected to nitrogen purge. Thereafter, while the alkali catalyst solution is stirred at 120 rpm, dripping of 200 parts of tetramethoxysilane (TMOS) and dripping of 158 parts of ammonia aqueous solution ($NH_4OH$) having a catalyst ($NH_3$) concentration of 3.8% in the following supply amounts are simultaneously started, thereby obtaining a suspension of silica particles (silica particle suspension).

The supply amount of the tetramethoxysilane is adjusted to 0.0017 mol/(mol·min) with respect to the total number of mols of the methanol in the alkali catalyst solution.

In addition, the supply amount of the 3.8% ammonia aqueous solution is adjusted to 0.27 mol/min with respect to 1 mol of the total supply amount of tetraalkoxysilane to be supplied per minute.

Step of Surface-Treating Silica Particles

An alcohol diluted solution in which tetrabutyl orthotitanate (tetra-n-butoxy titanium) as a titanium compound is diluted with butanol to be 1% by weight is prepared.

The alcohol diluted solution is added to a solution containing silica particles formed therein to conduct a reaction on surfaces of the silica particles to thereby perform a surface treatment, whereby silica particles are obtained. The alcohol diluted solution is added so that the tetrabutyl orthotitanate is 3.0 parts with respect to 100 parts of the silica particles.

Thereafter, 500 parts of the solvent of the obtained silica particle suspension is distilled away by thermal distillation, and 500 parts of pure water is added. Then, the obtained material is dried by a freeze dryer, thereby obtaining irregular hydrophilic silica particles.

Step of Subjecting Silica Particles to Hydrophobizing Treatment

Furthermore, 7 parts of hexamethyldisilazane is added to 35 parts of the hydrophilic silica particles, and the mixture is reacted at 150° C. for 2 hours, thereby obtaining irregular hydrophobic silica particles in which the surfaces of the particles are subjected to a hydrophobizing treatment.

The hydrophobic silica particles obtained through the above steps are set as silica particles A1.

Silica Particles A2 to A13, C1 to C6

Silica particles A2 to A13 and C1 to C6 are obtained in the same manner as in Example 1, except that the conditions of the alkali catalyst solution preparation step, the particle forming step, and the silica particle surface treatment step are changed in accordance with Table 1.

However, in the case of the silica particles A10, tetraisopropyl orthotitanate is used in place of tetrabutyl orthotitanate.

In the case of the silica particles A11, tetraethyl orthotitanate is used in place of tetrabutyl orthotitanate.

In Table 1, "TMOS supply amount" is a supply amount of TMOS with respect to the number of mols of the alcohol of the alkali catalyst solution.

In addition, "$NH_3$ supply amount" represents the number of mols per 1 mol of the total supply amount of the organic metal compound to be supplied per minute.

The abbreviations in Table 1 are as follows.

"TBT": Tetrabutyl Orthotitanate (tetra-n-butoxy titanium)

"BuOH": Butanol

"TET": Tetraethyl Orthotitanate

"TIPT": Tetraisopropyl Orthotitanate

Titanium Oxide Particles CC1

As titanium oxide particles CC1, titanium oxide particles TT0-55(C) (manufactured by Ishihara Sangyo Kaisha, Ltd., average particle diameter: 45 nm), that are available on the market, are directly used.

Examples 1 to 13

Comparative Examples 1 to 7

2 parts of silica particles according to Table 2 are added to 100 parts of toner particles, and mixed at 2000 rpm for 3 minutes by a Henschel mixer to obtain a toner.

Each obtained toner and a carrier are put into a V-blender at a ratio of 5:95 (toner:carrier) (mass ratio) and stirred for 20 minutes to obtain each developer.

As the carrier, a carrier prepared as follows is used.

Ferrite Particles (volume average particle diameter: 50 μm): 100 parts

Toluene: 14 parts

Styrene-Methyl Methacrylate Copolymer (component ratio: 90/10, Mw: 80000): 2 parts Carbon Black (R330, manufactured by Cabot Corporation): 0.2 part First, the above components, excluding the ferrite particles, are stirred for 10 minutes by a stirrer to prepare a coating liquid in which the material obtained by stirring is dispersed. Next, the coating liquid and the ferrite particles are put into a vacuum degassing-type kneader and stirred for 30 minutes at 60° C., and then degassed and dried by reducing the pressure while performing heating, thereby obtaining a carrier.

Physical Properties

Physical Properties of Silica Particles

Regarding the silica particles of the toner obtained in each of the examples, the titanium content in the surface layer of the silica particles, the average particle diameter, the particle size distribution, and the average circularity are examined in accordance with the above-described methods, respectively.

Regarding the respective silica particles, the titanium content is quantified with the NET intensity of the constituent element in the particles using a fluorescent X-ray analyzer XRF 1500 (manufactured by Shimadzu Corporation), and examined by performing mapping using SEM-EDX (manufactured by Hitachi, Ltd., S-3400N). As a result, it is confirmed that titanium is present in the surface layer of the silica particles.

Experimental Evaluation

A developing machine of a modified "DocuCentre Color 400" (manufactured by Fuji Xerox Co., Ltd.) is filled with the electrostatic charge image developer obtained in each of the examples, and the transfer efficiency, fogging, and image density are evaluated.

Transfer Efficiency

The transfer efficiency is evaluated as follows. As for test procedures, first, a developing potential is adjusted so that a toner amount is 5 g/m$^2$ on a photoreceptor under the environment of a temperature of 10° C. and a humidity of 20 RH %. Next, the evaluation machine is stopped immediately after transfer of the toner developed on the photoreceptor to an intermediate transfer member (intermediate transfer belt). Therefore, the toner remains on the photoreceptor in the post-transfer state (before cleaning). This toner is collected using mending tape, and a toner weight at that time is measured. The transfer efficiency is obtained from a ratio between the toner amount at the time of developing and the toner amount after transfer on the basis of the following expression. The transfer efficiency is measured after continuous output of an image having an image area of 5% on 50000 pieces of A4 paper. In addition, as an initial state, the transfer efficiency is measured also before the continuous output on 50000 pieces of paper.

Transfer Efficiency Toner Amount on Paper after Transfer/Toner Amount on Photoreceptor×100 Expression:

The transfer efficiency evaluation standards are as follows.

A: From 95% to 100% in Transfer Efficiency

B: From 90% to less than 95% in Transfer Efficiency

C: From 85% to less than 90% in Transfer Efficiency

D: From 80% to less than 85% in Transfer Efficiency

E: Less than 80% in Transfer Efficiency

Fogging

An image having an image density of 20% and a size of 4 cm×4 cm is output on 50000 pieces of A4 paper under conditions of 25° C./80% RH, and the fogging of the 10th output image (in the Table, "initial") and the fogging of the 50000th output image are evaluated as follows. The output images are visually evaluated (the presence or absence of the toner on the non-image part is confirmed using a loupe).

The evaluation standards are as follows.

A: No fogging occurs.

B: Slight fogging occurs, but there are no problems in image quality.

C: Fogging occurs.

Image Density Fluctuation

An image having an image density of 20% and a size of 4 cm×4 cm is output on 50000 pieces of A4 paper under conditions of 25° C./80RH, and the image density fluctuation of the 10th output image (in the Table, "initial") and the image density fluctuation of the 50000th output image are measured using X-rite 938 (manufactured by X-rite).

The evaluation standards are as follows.

A: 0.5 or less in Density Difference

B: From greater than 0.5 to 1.0 in Density Difference

C: From greater than 1.0 to 1.5 in Density Difference

D: Greater than 1.5 in Density Difference

White Voids in Image

An image having an image density of 20% and a size of 10 cm×10 cm is output on 50000 pieces of A4 paper under conditions of 25° C./80% RH, and the white voids in the 10th output image (in the Table, "initial") and the white voids in the 50000th output image are evaluated as follows. The output images are visually evaluated.

The evaluation standards are as follows.

A: No white voids are confirmed.

B: It is possible to confirm 1 or 2 white voids.

C: It is possible to confirm from 3 to 5 white voids.

D: There are 6 or more white voids.

Table 2 shows a list of the evaluation results with the characteristics of the silica particles as an external additive

TABLE 1

| | Alkalii Catalyst | | | Particle Forming Step (TMOS and Ammonia Aqueous Solution Supply Conditions) | | | | Surface Treatment Step (Composition of Alcohol Diluted Solution and Supply Condition) | | |
|---|---|---|---|---|---|---|---|---|---|---|
| | Solution Preparation Step (Alkali Catalyst Solution Composition) | | | | | | | | | |
| Silica Particles No. | Methanol Parts by Weight | Ammonia Aqueous Solution Parts by Weight | $NH_3$ Amount (mol/L) | Total TMOS Supply Amount Parts by Weight | TMOS Supply Amount (mol/mol · min) | Total Ammonia Aqueous Solution Supply Amount Parts by Weight | $NH_3$ Supply Amount [mol/min] | Alcohol Diluted Solution Composition/ Titanium Compound Concentration — | Titanium Compound Supply Amount (with respect to 100 parts of silica particles) Parts by Weight | Hydrophobizing Step Presence or Absence — |
| A1 | 400 | 66 | 0.68 | 200 | 0.0017 | 158 | 0.27 | TBT + BuOH/ 1.0% by weight | 3.0 | Presence |
| A2 | 400 | 66 | 0.68 | 198 | 0.0013 | 167 | 0.22 | TBT + BuOH/ 1.0% by weight | 0.0024 | Presence |
| A3 | 400 | 66 | 0.68 | 196 | 0.0013 | 180 | 0.24 | TBT + BuOH/ 1.0% by weight | 9.8 | Presence |
| A4 | 400 | 66 | 0.68 | 93 | 0.00039 | 380 | 0.32 | TBT + BuOH/ 1.0% by weight | 3.0 | Presence |
| A5 | 400 | 66 | 0.68 | 802 | 0.0035 | 182 | 0.16 | TBT + BuOH/ 1.0% by weight | 3.0 | Presence |
| A6 | 400 | 66 | 0.68 | 203 | 0.00025 | 1212 | 0.30 | TBT + BuOH/ 1.0% by weight | 3.0 | Presence |
| A7 | 400 | 66 | 0.68 | 201 | 0.0091 | 34 | 0.31 | TBT + BuOH/ 1.0% by weight | 3.0 | Presence |
| A8 | 400 | 66 | 0.68 | 194 | 0.0035 | 11 | 0.04 | TBT + BuOH/ 1.0% by weight | 3.0 | Presence |
| A9 | 400 | 66 | 0.68 | 197 | 0.0030 | 121 | 0.37 | TBT + BuOH/ 1.0% by weight | 3.0 | Presence |
| A10 | 400 | 66 | 0.68 | 200 | 0.0017 | 158 | 0.27 | TIPT + BuOH/ 1.0% by weight | 3.0 | Presence |
| A11 | 400 | 66 | 0.68 | 200 | 0.0017 | 158 | 0.27 | TET + BuOH/ 1.0% by weight | 3.0 | Presence |
| Cl | 400 | 66 | 0.68 | 197 | 0.0013 | 226 | 0.30 | — | 0 | Presence |
| C2 | 400 | 66 | 0.68 | 200 | 0.0017 | 158 | 0.27 | TBT + BuOH/ 1.0% by weight | 10.2 | Presence |
| C3 | 400 | 66 | 0.68 | 89 | 0.0030 | 49 | 0.33 | TBT + BuOH/ 1.0% by weight | 3.0 | Presence |
| C4 | 400 | 66 | 0.68 | 879 | 0.0048 | 246 | 0.27 | TBT + BuOH/ 1.0% by weight | 3.0 | Presence |
| C5 | 400 | 66 | 0.68 | 201 | 0.00022 | 1363 | 0.30 | TBT + BuOH/ 1.0% by weight | 3.0 | Presence |
| C6 | 400 | 66 | 0.68 | 198 | 0.011 | 23 | 0.26 | TBT + BuOH/ 1.0% by weight | 3.0 | Presence |
| A12 | 400 | 66 | 0.68 | 201 | 0.0030 | 7 | 0.02 | TBT + BuOH/ 1.0% by weight | 3.0 | Presence |
| A13 | 400 | 66 | 0.68 | 203 | 0.0021 | 202 | 0.42 | TBT + BuOH/ 1.0% by weight | 3.0 | Presence |

TABLE 2

| | Silica Particles (External Additive) | | | | | Transfer Efficiency | | Fogging | | | White Voids in image | |
|---|---|---|---|---|---|---|---|---|---|---|---|---|
| | No | Titanium Content in Surface Layer (%) | Average Particle Diameter D50v (nm) | Particle Size Distribution Index | Average Circularity | Initial | After 50,000 Pieces of Paper | Initial | After 50,000 Pieces of Paper | Image Density Fluctuation | Initial | After 50,000 Pieces of Paper |
| Example 1 | A1 | 2.5 | 132 | 1.31 | 0.75 | A | A | A | A | A | A | A |
| Example 2 | A2 | 0.002 | 130 | 1.30 | 0.70 | A | A | A | A | B | A | C |
| Example 3 | A3 | 9.8 | 128 | 1.30 | 0.72 | A | A | A | A | B | A | C |
| Example 4 | A4 | 2.5 | 32 | 1.28 | 0.80 | B | C | A | A | B | A | A |
| Example 5 | A5 | 2.5 | 490 | 1.35 | 0.65 | A | A | B | B | B | B | C |
| Example 6 | A6 | 2.5 | 135 | 1.12 | 0.78 | A | A | A | B | B | A | A |

TABLE 2-continued

| | Silica Particles (External Additive) | | | | | Transfer Efficiency | | Fogging | | | White Voids in image | |
|---|---|---|---|---|---|---|---|---|---|---|---|---|
| | No | Titanium Content in Surface Layer (%) | Average Particle Diameter D50v (nm) | Particle Size Distribution Index | Average Circularity | Initial | After 50,000 Pieces of Paper | Initial | After 50,000 Pieces of Paper | Image Density Fluctuation | Initial | After 50,000 Pieces of Paper |
| Example 7 | A7 | 2.5 | 133 | 1.48 | 0.79 | A | B | A | B | B | B | C |
| Example 8 | A8 | 2.5 | 127 | 1.35 | 0.54 | A | A | A | B | A | A | B |
| Example 9 | A9 | 2.5 | 129 | 1.34 | 0.84 | A | B | A | B | B | A | B |
| Example 10 | A10 | 2.5 | 132 | 1.31 | 0.75 | A | A | A | A | A | A | A |
| Example 11 | A11 | 2.5 | 132 | 1.31 | 0.75 | A | A | A | A | A | A | A |
| Comparative Example 1 | C1 | 0 | 129 | 1.30 | 0.78 | A | D | B | C | D | B | D |
| Comparative Example 2 | C2 | 10.2 | Two Peaks in Particle Size Distribution | | | — | — | — | — | — | — | — |
| Comparative Example 3 | C3 | 2.5 | 28 | 1.34 | 0.81 | C | E | C | C | D | A | D |
| Comparative Example 4 | C4 | 2.5 | 511 | 1.38 | 0.75 | B | D | C | C | D | C | D |
| Comparative Example 5 | C5 | 2.5 | 133 | 1.08 | 0.78 | A | C | C | C | C | A | D |
| Comparative Example 6 | C6 | 2.5 | 130 | 1.52 | 0.74 | A | B | C | C | D | B | D |
| Example 12 | C7 | 2.5 | 133 | 1.34 | 0.48 | A | B | C | C | C | C | C |
| Example 13 | C8 | 2.5 | 135 | 1.32 | 0.89 | B | C | C | C | C | C | C |
| Comparative Example 7 | Titanium Oxide Particles CC1 (conventional product) | | | | | C | E | C | C | D | C | D |

From the above results, it is found that all of the examples obtain better results than the comparative examples in the evaluations of the transfer efficiency, fogging, image density fluctuation, and white voids in the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles; and silica particles that have a titanium content of from 0.001% by weight to 10% by weight in a surface layer, an average particle diameter of from 30 nm to 500 nm, and a particle size distribution index of from 1.1 to 1.5, and are surface-treated with a titanium compound in which an organic group is bonded to a titanium atom via an oxygen atom, and a hydrophobizing agent in sequence.

2. The electrostatic charge image developing toner according to claim 1, wherein the silica particles have an average circularity of from 0.5 to 0.85.

3. The electrostatic charge image developing toner according to claim 1, wherein the toner particles include a polyester resin.

4. The electrostatic charge image developing toner according to claim 3, wherein a content of the polyester resin is from 40% by weight to 95% by weight with respect to the entire toner particles.

5. The electrostatic charge image developing toner according to claim 3, wherein the polyester resin has a weight average molecular weight (Mw) of from 5000 to 1000000.

6. The electrostatic charge image developing toner according to claim 3, wherein the polyester resin has a molecular weight distribution Mw/Mn of from 1.5 to 100.

7. The electrostatic charge image developing toner according to claim 1, wherein the toner particles include a release agent.

8. The electrostatic charge image developing toner according to claim 7, wherein the release agent has a melting temperature of from 50° C. to 110° C.

9. The electrostatic charge image developing toner according to claim 7, wherein a content of the release agent is from 1% by weight to 20% by weight with respect to the entire toner particles.

10. The electrostatic charge image developing toner according to claim 1, wherein the toner particles have a volume average particle diameter (D50v) of from 2 μm to 10 μm.

11. The electrostatic charge image developing toner according to claim 1, wherein the toner particles have a shape factor SF1 of from 110 to 150.

12. The electrostatic charge image developing toner according to claim 1, wherein the silica particles have an average particle diameter of from 30 nm to 500 nm.

13. The electrostatic charge image developing toner according to claim 1, wherein the silica particles have a particle size distribution index of from 1.1 to 1.5.

14. The electrostatic charge image developing toner according to claim 1, wherein the silica particles are obtained through: preparing an alkali catalyst solution in which an alkali catalyst is contained in an alcohol-containing solvent; forming silica particles by supplying tetraalkoxysilane and an alkali catalyst to the alkali catalyst; surface-treating the silica particles with a titanium compound by adding a mixture of the titanium compound in which an organic group is bonded to a titanium atom via an oxygen atom and an alcohol to the alkali catalyst solution containing the formed silica particles; and surface-treating, with a hydrophobizing agent, the silica particles surface-treated with the titanium compound.

15. The electrostatic charge image developing toner according to claim 14, wherein the silica particles are obtained through: preparing an alkali catalyst solution in which an alkali catalyst is contained at a concentration of from 0.6 mol/L to 0.85 mol/L in an alcohol-containing solvent; forming silica particles by supplying, to the alkali catalyst solution, tetraalkoxysilane in a supply amount of from 0.001 mol/(mol·min) to 0.01 mol/(mol·min) with respect to the alcohol and supplying an alkali catalyst in an amount of from 0.1 mol to 0.4 mol per 1 mol of a total supply amount of the tetraalkoxysilane that is supplied per minute; surface-treating the silica particles with a titanium compound by supplying a mixture of the titanium compound in which an organic group is bonded to a titanium atom via an oxygen atom and an alcohol to the alkali catalyst solution containing the formed silica particles; and surface-treating, with a hydrophobizing agent, the silica particles surface-treated with the titanium compound.

16. An electrostatic charge image developer comprising:

the electrostatic charge image developing toner according to claim 1.

17. A process cartridge that is detachable from an image forming apparatus, comprising:

a developing unit that contains the electrostatic charge image developer according to claim 16 and develops an electrostatic charge image formed on an image holding member with the electrostatic charge image developer to form a toner image.

18. An image forming apparatus comprising:

an image holding member;

a charging unit that charges a surface of the image holding member;

an electrostatic charge image forming unit that forms an electrostatic charge image on a charged surface of the image holding member;

a developing unit that contains the electrostatic charge image developer according to claim 16 and develops the electrostatic charge image formed on the surface of the image holding member with the electrostatic charge image developer to form a toner image;

a transfer unit that transfers the toner image formed on the surface of the image holding member onto a surface of a recording medium; and a fixing unit that fixes the toner image transferred onto the surface of the recording medium.

19. An image forming method comprising:

charging a surface of an image holding member;

forming an electrostatic charge image on a charged surface of the image holding member;

developing the electrostatic charge image formed on the surface of the image holding member with the electrostatic charge image developer according to claim 16 to form a toner image;

transferring the toner image formed on the surface of the image holding member onto a surface of a recording medium; and fixing the toner image transferred onto the surface of the recording medium.

20. A toner cartridge that accommodates the electrostatic charge image developing toner according to claim 1 and is detachable from an image forming apparatus.

* * * * *